United States Patent [19]

Wendt

[11] 4,236,259

[45] Dec. 2, 1980

[54] SPA COVER

[75] Inventor: Gary R. Wendt, Santa Ana, Calif.

[73] Assignee: Wendy S. Crane, Santa Ana, Calif. ; a part interest

[21] Appl. No.: 126,353

[22] Filed: Mar. 3, 1980

[51] Int. Cl.[3] ..... E04H 3/16; E04H 3/18

[52] U.S. Cl. ..... 4/498; 4/580 4/172.14

[58] Field of Search ..... 4/172.12, 172, 172.13, 4/172.14, 172.11

[56] References Cited

U.S. PATENT DOCUMENTS

| | | | |
|---|---|---|---|
| 3,483,863 | 12/1969 | DeVane | 4/172 |
| 3,488,782 | 1/1970 | Billig et al. | 4/172 |
| 3,916,457 | 11/1975 | Morita | 4/172.12 |
| 3,969,776 | 7/1976 | Gildea | 4/172 |
| 4,059,855 | 11/1977 | Riendeau | 4/172.14 |
| 4,126,905 | 11/1978 | Russell et al. | 4/172 |
| 4,181,986 | 1/1980 | Aine | 4/172.13 |
| 4,195,622 | 4/1980 | Dolza et al. | 4/172.13 X |

*Primary Examiner*—Henry K. Artis
*Attorney, Agent, or Firm*—Daniel C. McKown

[57] ABSTRACT

An insulative spa cover of the floating type used for reducing loss of heat from the warm water in the spa to the air above the water consists of a sheet of stiff plastic foam shaped to fit the spa. The outer portion of the sheet includes a number of panels that extend to the edge of the sheet and that are hinged to the remainder of the sheet so that the panels can be doubled back to lie on top of the remainder of the sheet to provide, at the edge of the sheet, access to the water without the necessity of removing the spa cover from the spa. This permits heat loss to be minimized when the spa is used by only a limited number of persons. The side of the panel that is exposed when the panel is doubled back is provided with receptacles for holding containers of food and drink.

14 Claims, 2 Drawing Figures

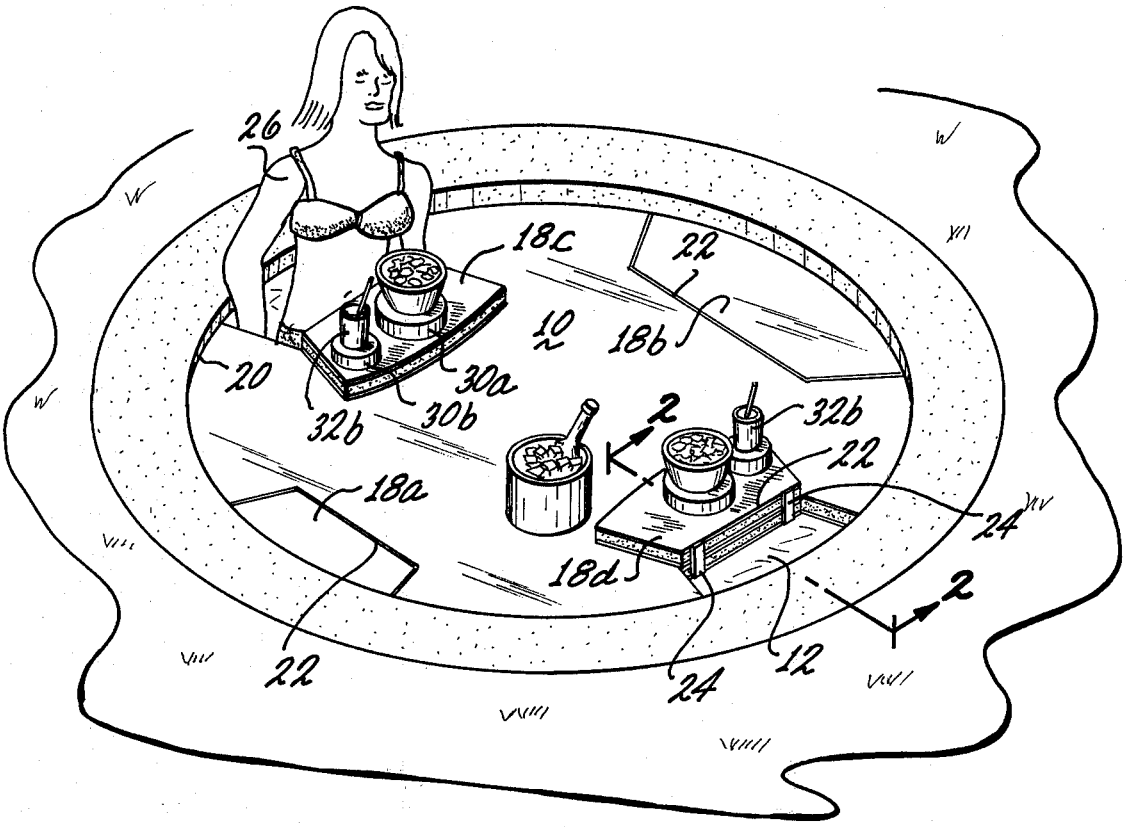
FIG. 1
FIG. 2
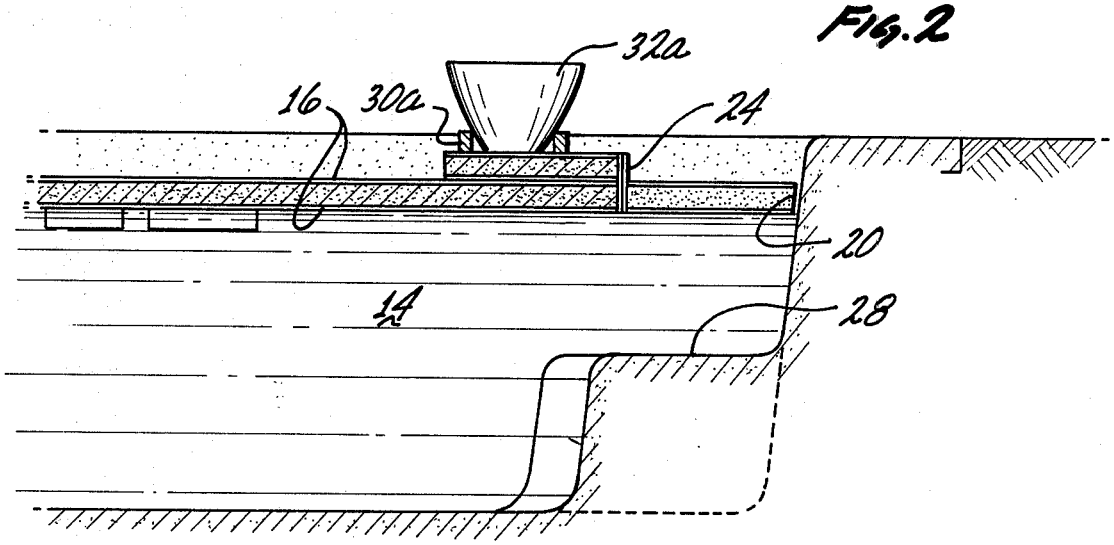

SPA COVER

BACKGROUND OF THE INVENTION

In recent years spas have been installed by many families, reflecting a growing recognition of the healthful and soothing benefits of spa bathing. Spas are also much enjoyed in winter sport centers, such as ski resorts, where the temperature of the surrounding air may be quite cold.

The cold ambient temperature results in a considerable heat loss from the surface of the water to the air above the water. But even when the ambient temperature is warm, some heat is lost because the water in the spa is appreciably warmer than the temperature of the air.

This heat loss is an energy loss, and the desirability of minimizing the loss is apparent from the viewpoints of both energy conservation and cost. To this end, it is known in the art to provide a spa cover in the form of a sheet of stiff foamed plastic of the closed-cell type, the sheet being generally the size and shape of the exposed water surface and floating thereon.

Such a spa cover might typically be eight feet in diameter, and therefore awkward to handle and to store. To render such spa covers less awkward in handling and storage, it is known in the art to construct the spa cover so it can be folded in half.

A spa cover that folds in half gives the owner two options. Either he can remove the spa cover altogether, particularly if a large number of persons will be using the spa concurrently; or, he can fold one half over onto the other half so as to be congruent with it. This latter option probably would be chosen if only one or two persons were to use the spa. However, even in this case, the heat loss is excessive because the water surface area exposed greatly exceeds the area needed to accommodate the users. Thus there exists a need for a more efficient spa cover—one which achieves high efficiency even when the spa is being used by only one person.

SUMMARY OF THE INVENTION

The spa cover of the present invention is responsive to this need for greater efficiency, and at the same time provides convenience features not previously available in spa covers.

In a first aspect of the invention, only sufficient water surface area is exposed to accommodate the number of persons using the spa concurrently. In a preferred embodiment this is accomplished by providing a number of hinged panels spaced around the periphery of the spa cover. These panels have different sizes. The smallest panel, when folded back onto the remainder of the cover, exposes a water surface area just large enough to accommodate a solitary user. The next larger panel exposes enough area to accommodate two users sitting side-by-side. More than one panel of each size may be provided, depending on the size and shape of the spa.

The present invention maximizes efficiency when only a limited number of persons are using the spa concurrently by limiting the exposed water surface area to that area necessary to accommodate the bathers.

In a second aspect of the invention, the undersides of the panels, which are exposed when the panels are folded back, are provided with receptacles for holding containers of food and drink. The receptacles steady the containers against accidental bumping of the spa cover by the bathers and against vibrations of the spa cover caused by the turbulence of the water.

Most spas include a ledge on which the bathers normally sit with their backs to the edge of the spa. When the bathers are seated in this manner, they find it awkward to reach around behind themselves to pick up items of food and drink sitting on the deck surrounding the spa. Dining is far more graceful if the food and drink are in front of the bather. However, if no receptacles were provided, the food and drink would be subject to the aforementioned accidental bumping and vibrating. Thus it is seen that this second aspect of the present invention makes practical a hitherto overlooked mode of dining—the luxurious spa picnic.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a perspective view showing the spa cover of the present invention in use; and FIG. 2 is a cross sectional elevation view in the direction 2—2 indicated in FIG. 1.

DETAILED DESCRIPTION OF THE PREFERRED EMBODIMENT

Turning now to the drawings in which like parts are denoted by the same reference numeral throughout, there is shown in FIGS. 1 and 2 a preferred embodiment of the spa cover 10 of the present invention floating on the surface 12 of the water 14 in the spa.

In a preferred embodiment, the spa cover consists of a stiff closed cell foamed plastic material of appropriate size and shape to cover substantially the entire surface 12 of the water in the spa. The sheet of material of the spa cover 10 may be formed with a smooth water-tight skin 16 that covers its exposed parts to prolong the useful life of the spa cover and to facilitate cleaning it. Alternatively, a watertight coating may be used in place of the skin 16.

A number of panels 18*a*, 18*b*, 18*c* and 18*d* are included the outer portion of the spa cover 10 adjacent the edge 20 of the spa cover. In a preferred embodiment these panels are four-sided, although in other embodiments other shapes are used. In the best mode, the hinged side 22 of the panel is straight.

In the preferred embodiment the panels 18*a*–18*d* are connected to the remainder of the spa cover 10 by hinges 24, which are strips of a pliable plastic, such as a VELCRO® fastener, in the preferred embodiment. The use of a VELCRO® fastener permits the trays to be removed from the remainder of the spa cover for cleaning, storage, or replacement. In other embodiments the hinges 24 may consist of strips of fabric, or of conventional pin hinges.

As best seen in FIG. 1, the panels normally are in either the closed position exemplified by the panels 18*a* and 18*b*, or in the open position exemplified by the panels 18*c* and 18*d*. When in the open position, the panels lie on top of the spa cover 10.

An important aspect is the size of the panels. In the preferred embodiment, the panels have various sizes. The smallest size panel, exemplified by the panels 18*a*, 18*c* and 18*d* are no larger than necessary to accommodate a solitary bather 26. That is, the panels 18*a*, 18*c* and 18*d* are only large enough to permit the bather 26 to enter the water 14 and to be seated on the ledge 28, to arise from the ledge 28 and to leave the spa. The panels 18*a*, 18*c* and 18*d* are limited in size in this manner to minimize the escape of heat from the exposed surface 12 of the water.

Other panels, exemplified by the panel 18*b* are large enough, but no larger than is necessary, to accommodate two bathers side-by-side.

It is expected that the panels will be kept in the closed position to conserve heat when no one is using the spa. A solitary bather would use the smallest size panel for the same reason. When so used, only sufficient water surface area is exposed to accommodate the number of persons actually using the spa.

In a second aspect of the invention, receptacles 30*a*, 30*b* are attached to the undersides of the panels 18*a*, 18*b*, 18*c* and 18*d* so that when the panels are doubled back to lie on the top of the spa cover, the receptacles will then be on the top side of the panels.

The receptacles 30*a*, 30*b* are used for holding containers 32*a*, 32*b* of food and drink for use by a bather in the spa, particularly those items which would be likely to be spilled or upset when the spa cover is accidentally bumped or in response to vibrations of the spa cover. In a preferred embodiment the receptacles have a hollow cylindrical shape, but in other embodiments the receptacles may have other shapes appropriate to the articles to be held.

The receptacles 30*a*, 30*b* suggest to the bather 26 that food can be consumed to provide activity while bathing. This propensity to eat may be further promoted for some bathers by watching television while in the spa, thereby promoting the sale of food at commercial spas.

Thus, there has been described an energy-conserving spa cover in which receptacles for containers of food and beverage are exposed to view only when the spa is being used.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. In a spa cover of the type including a sheet of a substantially rigid floating insulative material of such size and shape as to cover substantially the entire surface of the water in a spa to prevent heat loss from the water to the air above the water, the improvement comprising:

a panel including a portion of the edge of the spa cover, so attached to the remainder of the spa cover as to permit said panel to be doubled back on top of the remainder of the spa cover to provide at the edge of the spa cover access for a person to the water in the spa, to avoid having to remove the entire spa cover from the spa, thereby conserving the heat of the spa when the spa is used by only a limited number of persons.

2. The improvement of claim 1 wherein said panel is removably attached to the remainder of the spa cover.

3. In a spa cover of the type including a sheet of a substantially rigid floating insulative material of such size and shape as to cover substantially the entire surface of the water in a spa to prevent heat loss from the water to the air above the water, the improvement comprising:

a panel including a portion of the edge of the spa cover, so attached to the remainder of the spa cover as to permit said panel to be removed from the remainder of the spa cover to provide at the edge of the spa cover access for a person to the water in the spa, to avoid having to remove the entire spa cover from the spa, thereby conserving the heat of the spa when the spa is used by only a limited number of persons.

4. The improvement of claim 3 wherein said panel is so attached to the remainder of the spa cover as to permit said panel to be doubled back on top of the remainder of the spa cover.

5. In a spa cover of the type including a sheet of a substantially rigid floating insulative material of such size and shape as to cover substantially the entire surface of the water in a spa to prevent heat loss from the water to the air above the water, the improvement comprising:

a panel including a portion of the edge of the spa cover, so attached to the remainder of the spa cover as to permit said panel to be doubled back on top of the remainder of the spa cover to provide access at the edge of the spa cover to the water in the spa, said panel including, on the side of it that is exposed when said panel has been doubled back, receptacle means for receiving and holding containers of food and drink.

6. The improvement of claim 5 wherein said panel is hinged to the remainder of the spa cover.

7. The improvement of claim 5 wherein said panel is removably affixed to the remainder of the spa cover.

8. The improvement of claim 5 wherein said receptacle means further comprise a gasket affixed to said panel.

9. The improvement of claim 5 wherein said receptacle means further comprise a recessed area on the side of the panel that is exposed when said panel has been doubled back.

10. An insulative spa cover, comprising in combination:

a sheet of a substantially rigid floating insulative material of such size and shape as to cover substantially the entire surface of the water in a spa to prevent heat loss from the water to the air above the water;

said sheet further comprising a panel including a portion of the edge of said sheet, said panel so attached to the remainder of said sheet as to permit said panel to be doubled back on top of the remainder of said sheet to provide access at the edge of said sheet to the water in the spa, said panel including, on the side of it that is exposed when said panel has been doubled back, receptacle means for receiving and holding containers of food and drink.

11. The insulative spa cover of claim 10 wherein said panel is hinged to the remainder of said sheet.

12. The insulative spa cover of claim 10 wherein said panel is removably affixed to the remainder of said sheet.

13. The insulative spa cover of claim 10 wherein said receptacle means further comprise gasket affixed to said panel.

14. The insulative spa cover of claim 10 wherein said receptacle means further comprise a recessed area on the side of the panel that is exposed when said panel has been doubled back.

* * * * *